US005327846A

United States Patent [19]

Androus

[11] Patent Number: 5,327,846

[45] Date of Patent: Jul. 12, 1994

[54] WIND SCOOP FOR MARINE CRAFT

[76] Inventor: Theodore S. Androus, 9313 Old Mansion Rd., Alexandria, Va. 22309

[21] Appl. No.: 25,779

[22] Filed: Mar. 3, 1993

[51] Int. Cl.[5] ..... B63B 19/06

[52] U.S. Cl. ..... 114/211; 454/78

[58] Field of Search ..... 114/177-180, 114/212, 211; 454/2, 14, 37, 65, 64, 78, 81, 82

[56] References Cited

U.S. PATENT DOCUMENTS

| | | | |
|---|---|---|---|
| 1,115,315 | 10/1914 | Hunt . | |
| 2,084,338 | 6/1937 | Hamblin | 98/4 |
| 2,523,933 | 9/1950 | Akester et al. | 114/211 |
| 3,741,100 | 6/1973 | Beck | 98/37 |
| 3,757,664 | 9/1973 | Jalbert | 98/37 |
| 4,434,740 | 3/1984 | Childs | 114/211 |
| 4,706,593 | 11/1987 | Vail, Jr. | 114/211 |
| 4,759,271 | 7/1988 | Bliemeister | 114/211 |
| 4,938,123 | 7/1990 | Hilton | 98/37 |
| 5,022,339 | 6/1991 | Baskin | 114/211 |

FOREIGN PATENT DOCUMENTS 5112 of 1883 United Kingdom .

OTHER PUBLICATIONS

Marine catalog advertisements (p. 20) showing currently available Wind Scoops made by "Davis" Sailing Aids.

*Primary Examiner*—Stephen P. Avila

*Attorney, Agent, or Firm*—Costas S. Krikelis

[57] ABSTRACT

The present invention relates to an apparatus for ventilating the interior of a structure, and more particularly a wind scoop for directing a flow of air into the interior of a marine craft through an opening such as a hatch on the deck of the marine craft. The wind scoop has an adjustable top cover for preventing rain water from entering the opening while continuing the flow of air to the interior.

8 Claims, 6 Drawing Sheets

WIND SCOOP FOR MARINE CRAFT

BACKGROUND OF THE INVENTION

1. Field of the Invention

This invention relates to an apparatus for ventilating the interior of a structure, and more particularly a collapsible wind scoop for directing a flow of air into the interior of a marine craft through an opening such as a hatch on the deck of the marine craft.

2. Description of Related Art

In marine craft, the ventilation of the interior of various types of boats which include living space below deck is frequently a problem, especially when the craft is not moving. This problem is overcome by various types of ventilators or wind deflecting or directing assemblies which are specifically for use on a marine craft and which direct air from the exterior of the craft down through an opening, such as an open hatch, port or the like, into the interior of the craft. Exemplary ventilators for this purpose are disclosed in U.S. Pat. No. 4,434,740, U.S. Pat. No. 4,759,271, and U.S. Pat. No. 4,938,123.

U.S. Pat. No. 3,757,664 also discloses a cloth ventilator having an upper half formed of an X cross-section, a top cover spaced from the X cross-section portion, and a lower half formed as a diffuser of square cross-section. A particular problem with this ventilator is that rain can enter an opening into the marine craft. Although the ventilator has a top cover, rain falling from any angle other than vertical can enter into the opening of the marine craft. Also, any rain dripping down the lower half of the ventilator can enter the opening. Thus rainy weather would prohibit using the ventilator.

SUMMARY OF THE INVENTION

In accordance with this invention there is provided an adjustable wind scoop for directing a flow of air through an opening in an enclosed space to said space while preventing rain water from entering said opening, the wind scoop including an adjustable top cover, at least one pair of flexible battens, an upper wind catching portion having a predetermined cross-section, a lower wind directing portion having a generally rectangular cross-section, a means for securing the wind scoop to the opening in the enclosed space, and means for erecting the wind scoop over the opening, which means for erecting include means for attaching a means for supporting the wind scoop in an erect position and for adjusting said adjustable top cover, wherein:

a) the top cover comprises a sheet of flexible, waterproof material, shaped as a dome, having a concave underside surface with a generally rectangular base having four corners, and pocket means for receiving the pair of flexible battens extending on the underside surface of the dome along two intersecting diagonals connecting opposite corners, the rectangular base extending beyond the cross-section of the upper wind catching portion of the wind scoop;

b) the means for attaching the means for supporting and for adjusting is located on the top cover at about the point where the two diagonals intersect;

c) the upper wind catching portion having a top and a bottom and being also constructed of a flexible material and having an "X" shaped cross-section defining a center and four ends, the four ends at the top being attached to the underside of the top cover along points on the diagonals, spaced from the corners, the bottom extending at least partially into the lower wind directing portion and attached thereto; and d) the lower wind directing portion also having a top and a bottom, the means for securing the wind scoop to the opening in the enclosed space being attached to the bottom.

Further in accordance with this invention there is provided a wind scoop as hereinabove described that is collapsible for ease of storage. Said wind scoop may include an electric fan for forcibly directing an air flow in or out of said enclosed space.

BRIEF DESCRIPTION OF THE DRAWINGS

The invention can be more fully understood from the following detailed description thereof in connection with the accompanying drawing described as follows.

DESCRIPTION OF THE PREFERRED EMBODIMENT

Figure 1:
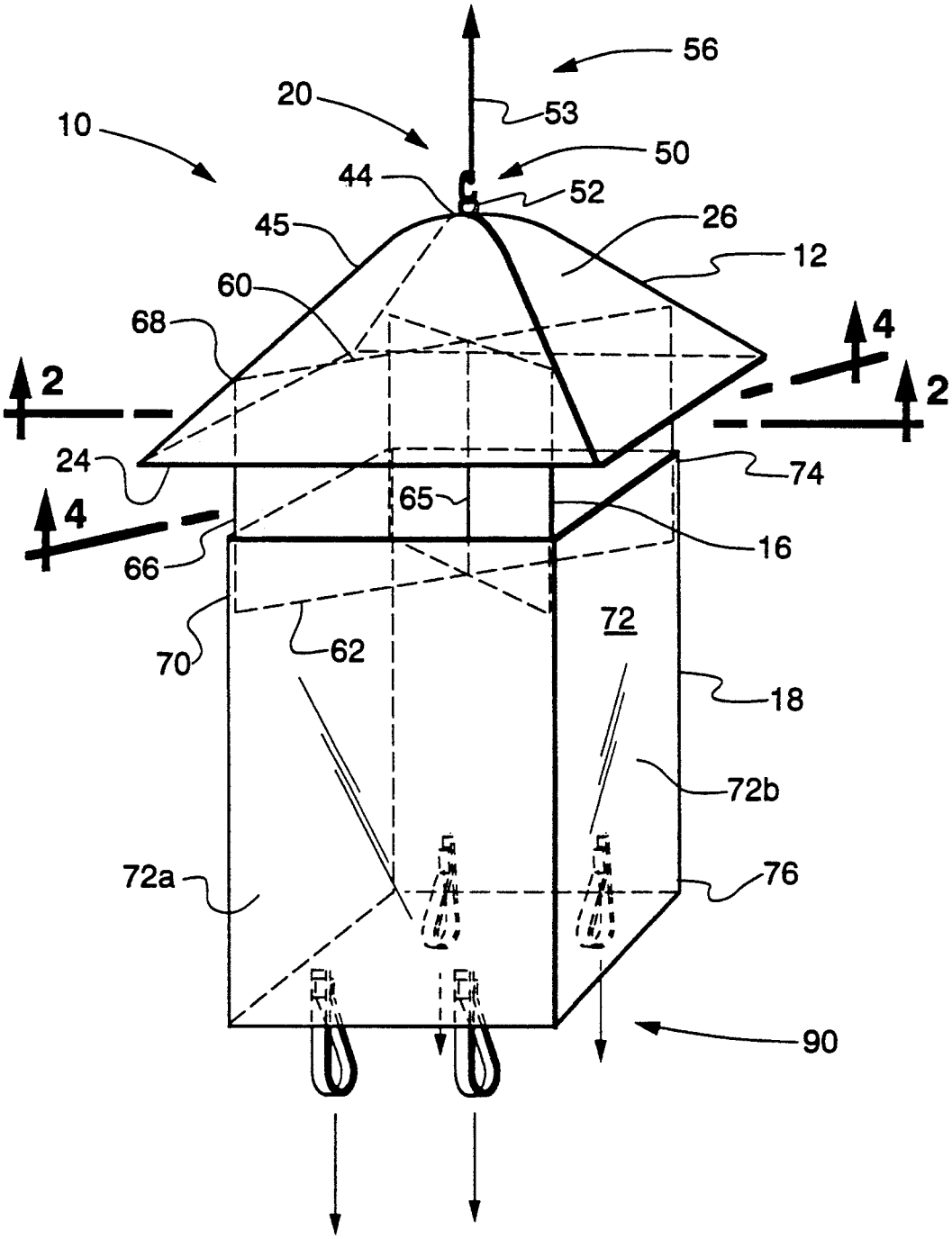
FIG. 1 is a schematic perspective view of a wind scoop having a top cover, a wind catching portion, a wind directing portion, and a means for erecting the wind scoop in accordance with the present invention.

Referring to FIG. 1, a wind scoop 10 is shown which includes an adjustable top cover 12, at least one pair of flexible battens 14 (shown in FIG. 2), an upper wind catching portion 16, a lower wind directing portion 18, and means 20 for erecting, the wind scoop 10 over an opening 21 (shown in FIG. 6) in a marine craft. The opening 21 in a marine craft is typically a closeable hatch and hereinafter the opening 21 may also be referred to as the hatch 21. The top cover 12, the upper wind catching portion 16, and the lower wind directing portion 18, of the wind scoop are constructed of flexible material, such as, for example, sail cloth, reinforced nylon, or canvas. At least the top cover 12 is waterproof. Sail cloth is preferred since it is flexible, strong and waterproof.

Figure 2:
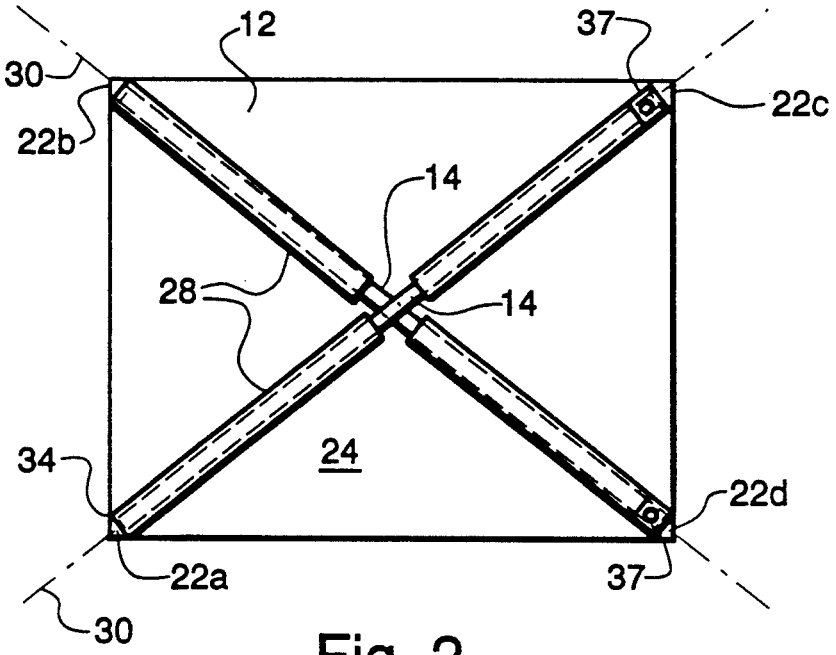
FIG. 2 is a planar view of a horizontal section of a top cover of the wind scoop taken along line 2—2 of FIG. 1.
Figure 2A:
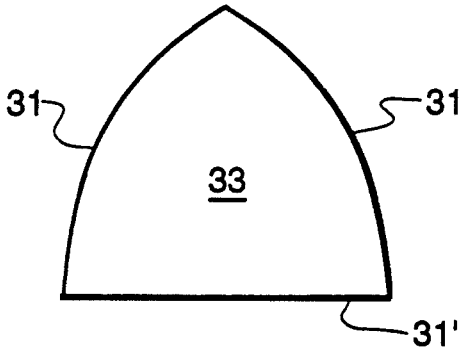
FIG. 2*a* illustrates one of four substantially identical panels used in constructing the top cover.

Referring to FIGS. 1, 2, and 2*a*, the top cover 12 forming a dome is generally rectangular shaped having four corners 22*a*, 22*b*, 22*c*, and 22*d*, an underside surface 24, and a top side 26. The dome shape is created by sewing together four generally triangular pieces 33 of material shaped as shown in FIG. 2*a*. The generally triangular pieces have at least two sides 31 convexly curved the third side 31' being preferably straight. The dome is formed by sawing the four pieces together along the curved sides 31.

The underside surface 24 of the top cover 12 has a means for receiving at least two flexible battens 14. The means for receiving the battens may comprise a pocket 28 extending between each of opposite corners 22*a* and 22*c*, and 22*b* and 22*d*, of intersecting diagonals 30. Although the pocket 28 can be single or multiple pocket enclosures along the diagonal 30 of the top cover 12, the pocket 28 will be referred to hereinafter as if it were a single enclosure along each diagonal 30.

Figure 3:
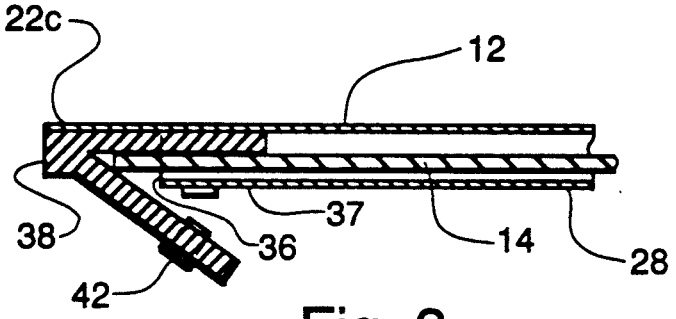
FIG. 3 is a schematic representation in cross-sectional view of a pocket opening at a corner of the top cover of the wind scoop.

One end 34 of each pocket 28, at or substantially near the corners 22*a*, and 22*b* is sealed to retain the batten 14 in the pocket 28. The opposite end 37 of each pocket 28, shown in detail in FIG. 3, has an opening 36 for inserting the batten 14 at or substantially near the corners 22*c*, and 22*d*.

At each of the pocket openings 36 extending on the diagonal 30 is a strapping 38 which is folded over on itself to close opening 36 and secure the batten in the pocket. The strapping is maintained in the closed position with, for example, a snap fastener 42.

The battens 14 are substantially the length of the diagonals 30 and slightly longer than the pockets 28, so that when the battens 14 are inserted in the pockets 28 and the opening 36 is closed, the battens 14 are compressed within pocket 28, causing the battens 14 to flex. The battens 14 flex to shape and hold open dome 45 akin to an umbrella. With the battens in place, the underside surface 24 of the dome 45 is concave and the battens 14 form an apex 44 of the dome 45 at the intersection of the diagonals 30. The dome 45 has a generally rectangular base 46 with four corners 22*a*–22*d*.

Figure 4:
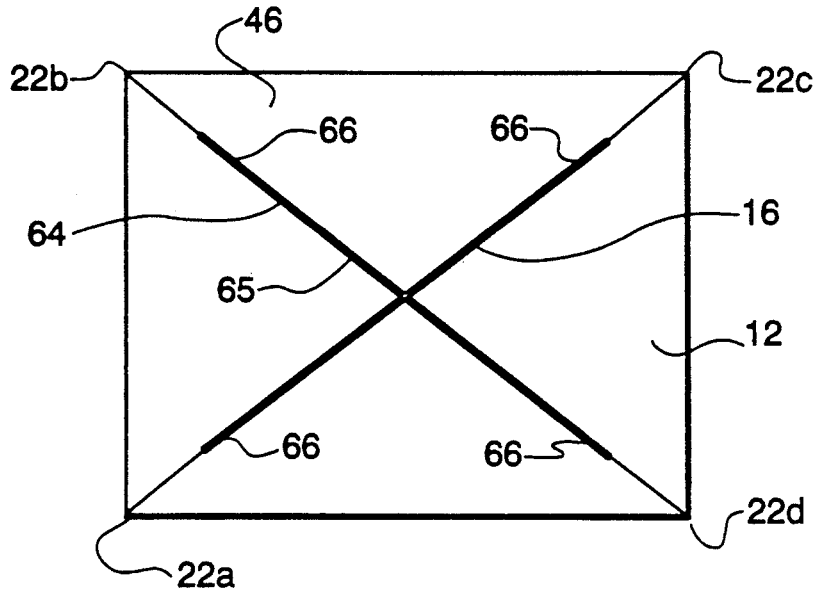
FIG. 4 is a planar view of a horizontal section of the wind scoop taken along line 4—4 of FIG. 1.

Referring to FIG. 4, the base 46 of the dome 45 extends beyond a cross-section of the wind catching portion 16, taken on a plane perpendicular to an axis 67 (better shown in FIG. 5) extending vertically along the centerline of the upper and lower portions of the wind scoop 10. Because the dome 45 of the top cover 12 extends beyond the wind catching portion 16, it prevents rain falling at an angle from entering into the wind scoop 10 and therefrom through the opening 21 to the interior of the marine craft.

A means 50 for attaching the wind scoop 10, is mounted to the top side 26 of the top cover 12 at about the point where the two diagonals 30 of the top cover 12 intersect. One embodiment of the means for attaching 50 comprises a loop 52 of cloth tape, such as, for example, nylon strapping. The top cover 12 of the wind scoop 10 can be attached by other means conventional to one skilled in the art. The means for attaching 50 the wind scoop 10 is coupled to a line 53 which may be a halyard, such as a jib halyard of a sailboat, and thereby erect the wind scoop 10 over hatch 21. The line 53 is a means 56 for supporting the wind scoop 10 in an erect position and for adjusting the top cover 12.

The battens 14 are thin, narrow strips and can be constructed of any material providing that they are sufficient in strength to support and maintain the shape of the dome 45 and are sufficiently flexible to bend as the shape of the dome 45 is adjusted, as will be explained later in the specification. The battens 14 are preferably constructed of wood or a glass fiber reinforced plastic.

The upper wind catching portion 16 has a top 60 and a bottom 62, and forms an X-shaped cross-section 64 having a center 65 and four ends 66. The center 65 of the X-shaped cross-section 64 is on a vertical center axis 67 (see FIG. 5) of the wind scoop 10. Each of the four corners 68 of the top 60 of the wind catching portion 16 is attached to the concave underside surface 24 of the top cover 12 between the corners 22*a*–22*d* and the apex 44 of the dome 45 on or substantially near the pockets 28. The X-shape cross-section 64 of the upper wind catching portion 16 is aligned or substantially aligned with the intersecting diagonals 30 of the top cover 12. The bottom 62 of the wind catching portion 16 extends at least partially into the lower wind directing portion 18. Each end 70 of the bottom 62 of the upper wind catching portion 16 is attached to the lower wind directing portion 18.

Figure 6:
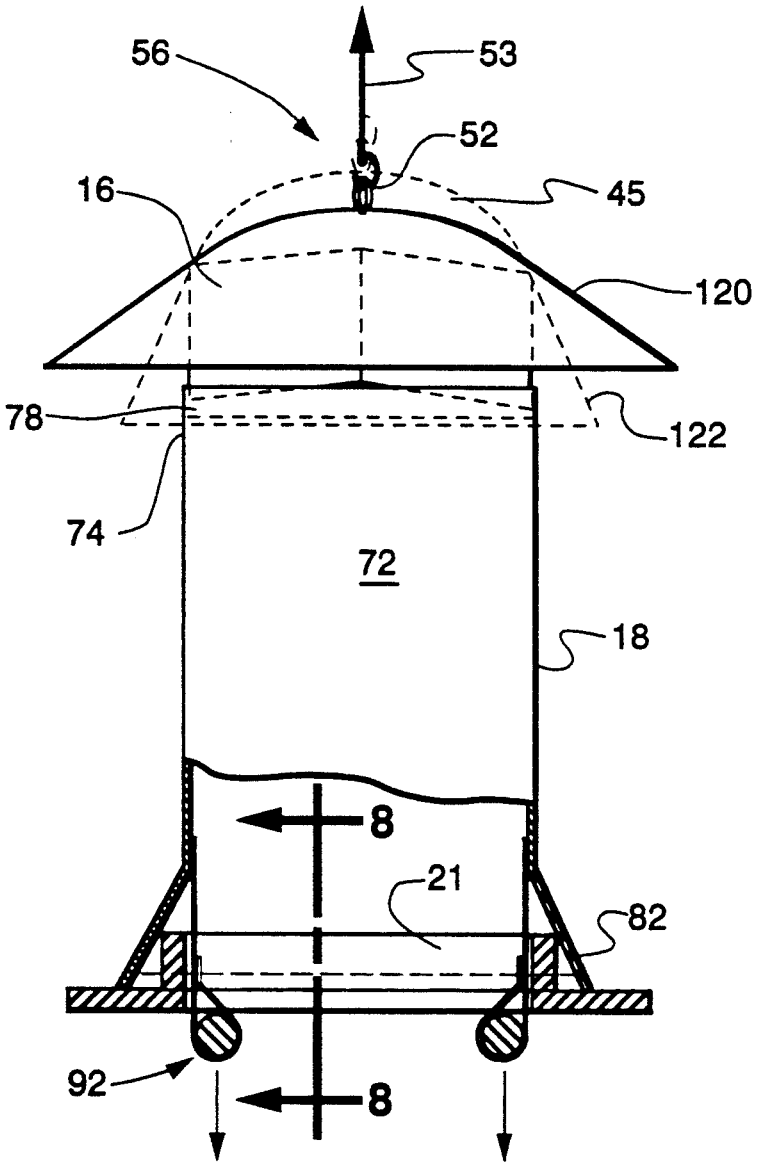
FIG. 6 is schematic cross-sectional elevation view of the wind scoop mounted over a hatch, showing the top cover in a first and in a second position.
Figure 6A:
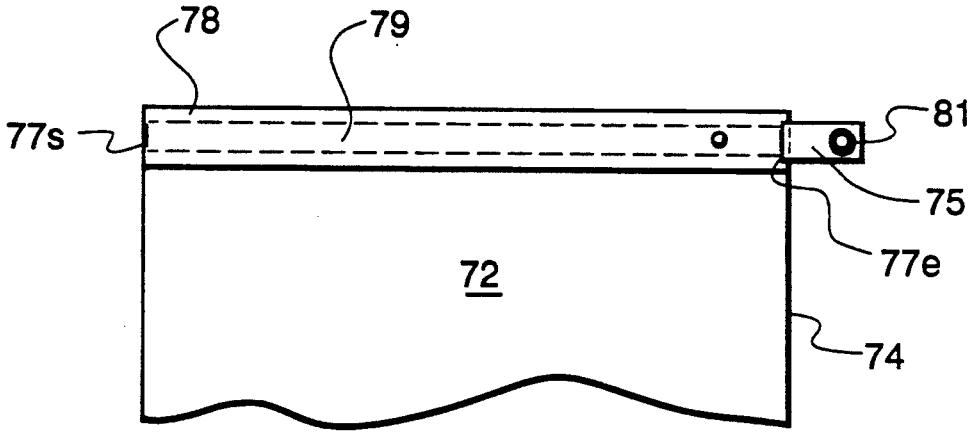
FIG. 6*a* is an illustration of a pocket at a top of a side of the lower wind directing portion used in an alternate embodiment of the present invention.

Referring to FIGS. 1, 6, 6*a*, 7, and 8, the lower wind directing portion 18 is generally rectangular shaped having four sides 72, a top 74 and a bottom 76. Each of the bottom ends 70 of the upper wind catching portion 16 are secured at each intersection of the sides 72 of the wind directing portion 18. Optionally, as shown in FIG. 6*a*, the top 74 of each side 72 of the lower wind directing portion 18 may have a pocket 78 in which a support batten 79 may be encased to prevent the top 74 of the side 72 of the lower wind directing portion 18 from collapsing and to maintain its rectangular shape. Each of the top pockets 78 for the lower wind directing portion 18 have a sealed end 77*s* and an open end 77*e* at or substantially near the intersections of the sides 72 respectively. The open end 77*e* of the top pocket 78 has strapping 75 which folds over the open end 77*e* and closes with, for example, a snap closure 81, to secure the support batten 79 in the pocket 78. The support battens 79 are substantially the same length as the top pocket 78.

Figure 7:
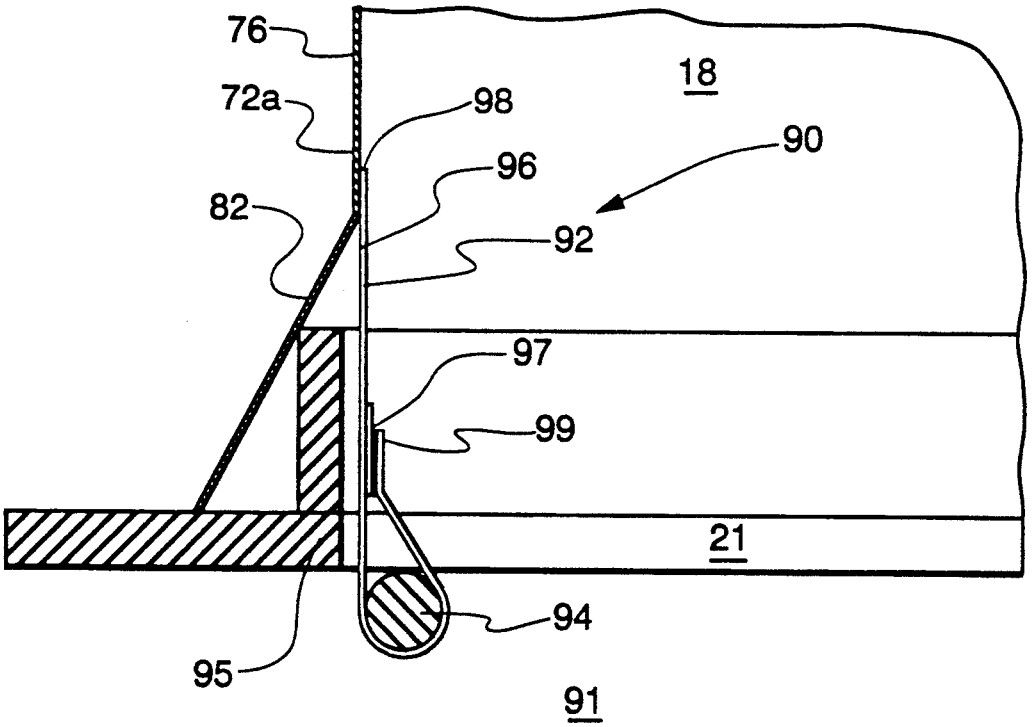
FIG. 7 is a detailed cross-sectional view of a means for securing the wind scoop.
Figure 8:
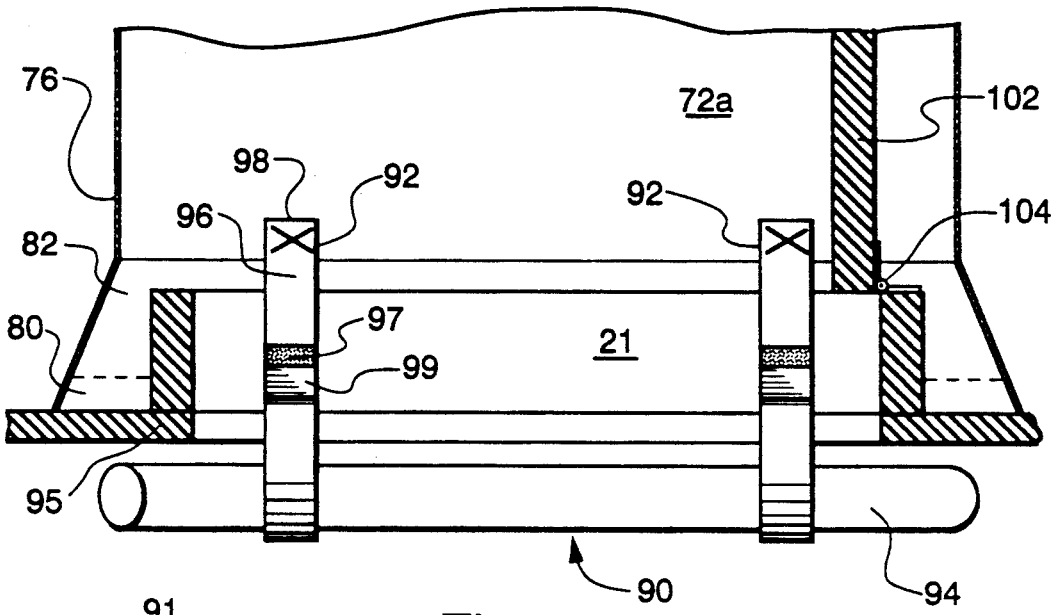
FIG. 8 is a cross section view of the means for securing the wind scoop, taken along line 8—8 of FIG. 6.

As better shown in FIGS. 7 and 8, the bottom 76 of the wind directing portion 18 has a pocket 80 in which weighted material, such as, for example, steel link chain, not illustrated, is encased. The bottom 76 of the wind directing portion 18 can be weighed down by other means conventional in the art, such as, for example, lead weights sewn along the bottom pocket. The wind directing portion 18, particularly near the bottom 76 of the wind directing portion 18 above the bottom pocket 80, is larger in cross-section than the hatch 21. The weighted pocket 80 of the bottom 76 of the wind directing portion 80 lies outside the hatch 21, forming a skirt 82 around the hatch 21. The skirt 82 prevents rain water traveling down the sides 72 of the lower wind directing portion 18 from entering into the hatch 21.

A means 90 for securing the wind scoop 10 to an enclosed space 91 through the hatch 21 is attached above the skirt 82 of the bottom 76 of the wind directing portion 18. The means for securing 90 include adjustable fasteners 92 and at least two rods 94. The lower wind directing portion 18 has two sides 72 opposite each other 72*a* and 72*b*. Each opposing side 72*a*, 72*b* has two adjustable fasteners 92 spaced apart from each other.

The adjustable fasteners 92 include elastic tape 96 and hook and loop tape 97. The elastic tape 96 has a first end 98 sewn to the wind directing portion 18 and a second end 99. Secured to the second end 99 of the elastic tape 96 is either the hook portion or loop portion of the hook and loop tape 97. Between the first end 98 and second end 99 of the elastic tape 96 is the other mating portion of the hook and loop tape 97. The rods 94 are longer than a longest dimension of the hatch 21 and are located inside the hatch 21 below frame supports 95 of the hatch 21. The adjustable fasteners 92 extend from the wind directing portion 18 into the hatch 21, wrap about the rod 94, and are secured by mating of the hook and loop tape 97. The elastic tape 96 of the fasteners 92 can easily adjust for changes in tension in the wind scoop 10.

The means for securing 90 provides resilient force against the means for supporting and for adjusting 56 of the wind scoop 10. The bottom 76 of the wind scoop 10 can be secured to the opening 21 by other means for securing conventional to one skilled in the art without effecting the scope of this invention.

The means 20 for erecting the wind scoop 10 over the opening 21 includes:

(a) the means 50 for attaching, e.g., the loop 52, (b) the means 56 for supporting the wind scoop 10 in an erect position and for adjusting the adjustable top cover 12, e.g., the line 53, and (c) the means 90 for securing the wind scoop 10 to the enclosed space 91 through the hatch 21.

Typically, the hatch 21 of a marine craft includes a cover 102 which is closeable and a frame 95 surrounding the hatch. The cover 102 is usually attached to the hatch frame with a hinge mount 104. At least the bottom 76 of the lower wind directing portion 18 of the wind scoop 10 is large enough to fit over the hatch and cover and completely encompass the hatch 21 while the cover 102 is kept opened above the hatch 21, as shown in FIG. 8. In order not to interfere with the hatch cover the means 90 for securing the wind scoop 10 to the hatch 21, e.g. the rods 94 and the supporting loops 96, are oriented along the sides 72, of the lower wind directing portion 18 perpendicularly to the hinged side of the hatch cover, so that the cover 102 of the hatch 21 can be adjusted or even closed, with the wind scoop 10 in place.

Figure 5:
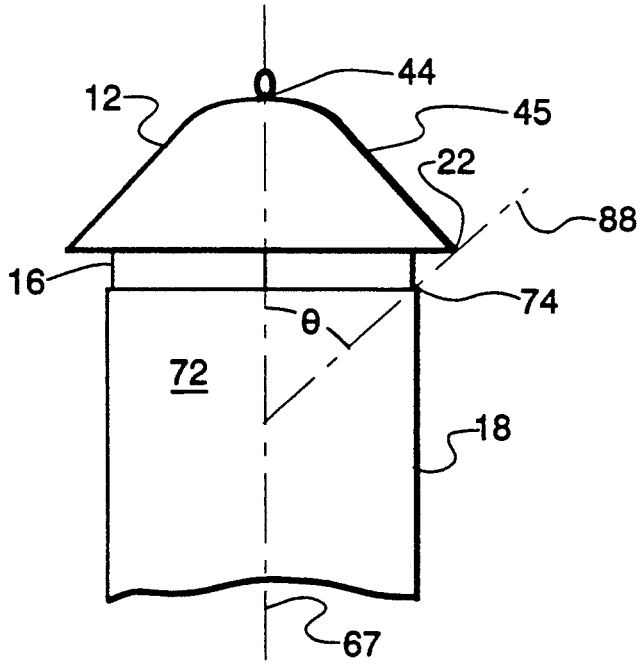
FIG. 5 is a schematic elevation view of the upper portion of the wind scoop.

Referring now to FIG. 5, when the wind scoop 10 is only under enough tension by the line 53, to be erect and supported, an angle $\theta$ measured between the vertical center axis 67 of the wind scoop 10 and a line 88 extending from the corner 22 of the top cover 12 through the intersection of the sides 72 at the top 74 of the lower wind directing portion 18 is a minimum of about 30°. Preferably, the angle $\theta$ is greater than about 50° and most preferably, greater than about 70° to prevent rain from entering into the wind scoop 10.

Figure 9:
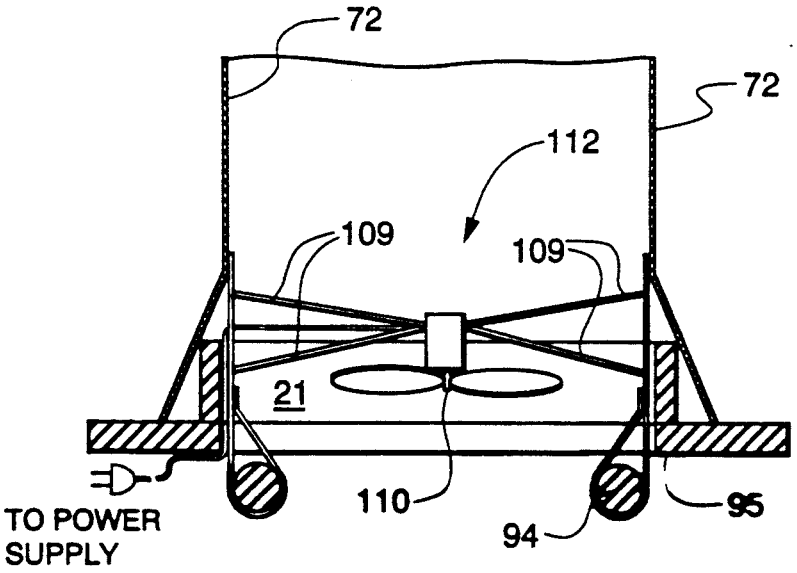
FIG. 9 is a view of a lower portion of an alternate embodiment of the wind scoop depicting a means for directing and for accelerating a flow of air.

Referring to FIG. 9, an electric fan 110 may optionally be included with the wind scoop 10 for directing and accelerating air flow through the wind scoop 10 when there is low or no wind condition. The electric fan 110 may be mounted with supports 109 to the sides 72 of the lower wind directing portion 18 of the wind scoop 10 or to the frame supports 95 of the hatch 21. The electric fan 110 connects to a power supply inside the marine craft. The electric fan 110 is a means 112 for forcible directing and accelerating the flow of air through the wind scoop 10.

Referring to FIG. 6, the wind scoop 10 is erected over the hatch 21 by attachment of the loop 52 to a line or halyard 53. The bottom 76 of the wind scoop 10 is secured to the enclosed space 91 over the hatch 21 by wrapping the adjustable fasteners around the rods 94 and mating the hook and loop tape 97 together. The bottom 76 of the wind directing portion 18 is weighted and remains outside of the frame 95 of the hatch 21 forming a skirt 82 over the hatch 21. At rest, the dome 45 extends out beyond the upper wind catching portion 16 in a first position 120, to capture a substantial amount of a flow of air in the upper wind catching portion 16 and into the lower wind directing portion 18 to direct the air flow downward into the opening 21.

In dry weather, the tension in line 53 is adjusted just sufficient to keep the wind scoop 10 erect and supported, with the elastic tape 96 of the adjustable fasteners 92 maintaining the tension and scoop position over the hatch, regardless of changes in the wind direction and intensity.

When it is raining, the wind scoop 10 of the present invention is adjustable to prevent rain from entering the hatch 21 while continuing ventilating the interior of the marine craft. During rainy weather, line 53 is pulled upwardly, increasing the tension applied axially on the wind scoop 10 and pulling the top cover 12 away from the hatch 21. Although the bottom 76 of the wind scoop 10 is secured with an elastic tape 96 on the adjustable fasteners 92, the amount of stretch available is limited and the scoop remains anchored to the hatch.

Since the upper wind catching portion 16 is attached to the underside of the dome, at points along the diagonals, as the top cover 12 is pulled away from the hatch 21, the battens 14 flex in toward the upper wind catching portion 16 and alter the shape of the dome 45 bringing it to a second position 122. The dome 45 in the second position 122, brings more of the upper wind catching portion 16 under the dome 45 and thus blocks rain from entering into the wind scoop 10 while still permitting air flow into the opening 21.

Rain dripping from and on the wind scoop 10 is prevented from entering the hatch 21 since the skirt 82 of the lower wind directing portion 18 is located outside the hatch 21 frame and covers the hatch 21 directing all water to the outside of the hatch. Thus, by adjusting the dome shape, the wind scoop of the present invention is effective at preventing rain from entering into the opening when the rain is falling from substantially any angle.

While the wind scoop function has been described in terms of air flow into the enclosed space 91, those familiar with the ventilation requirements of small craft will realize that depending on the particular location of the hatch and the presence of additional openings, the flow of air may be reverse, i.e. out of the opening through the wind scoop, particularly when the outside wind speed is minimal and the hatch is the forward hatch located near the bow of the marine craft. The wind scoop 10 is equally effective when operating in this alternate manner to exhaust the air in the enclosed space 91 up through the lower wind directing portion 18 and out of the upper wind catching portion 16.

The above described embodiment is only illustrative and not limiting of my invention. Those skilled in the art having the benefit of this disclosure may effect various modifications to this design including the use of different materials for the various parts of the wind scoop as well as variations in the size and shape of the dome and the wind catching and directing portions.

The above and other modifications are to be construed as falling within the scope of this my invention, which I claim:

1. An adjustable wind scoop for directing a flow of air through an opening in an enclosed space to said space while preventing rain water from entering said opening, the wind scoop including an adjustable top cover, at least one pair of flexible battens, an upper wind catching portion having a predetermined cross-section, a lower wind directing portion having a generally rectangular cross-section, a means for securing the wind scoop over the opening in the enclosed space, and means for erecting the wind scoop over the opening, which means for erecting include means for attaching a means for supporting the wind scoop in an erect position and for adjusting said adjustable top cover, wherein:

a) the top cover comprises a sheet of flexible, waterproof material, shaped as a dome, having a concave underside surface with a generally rectangular base having four corners, and pocket means for receiving the pair of flexible battens extending on the underside surface of the dome along two intersecting diagonals connecting opposite corners, the rectangular base extending beyond the cross-section of the upper wind catching portion of the wind scoop;

b) the means for attaching the means for supporting and for adjusting is located on the top cover at about the point where the two diagonals intersect;

c) the upper wind catching portion having a top and a bottom and being also constructed of a flexible material and having an "X" shaped cross-section defining a center and four ends, the four ends at the top being attached to the underside of the top cover along points on the diagonals, spaced from the corners, the bottom extending at least partially into the lower wind directing portion and attached thereto; and d) the lower wind directing portion also having a top and a bottom, the means for securing the wind scoop to the opening in the enclosed space being attached to the bottom.

2. The wind scoop according to claim 1 wherein the opening includes a hatch comprising a frame and wherein the wind scoop further comprises:

means for removably securing the lower wind directing portion of the scoop over said hatch, the means extending inside the opening, said means for removably securing being attached to the lower wind directing portion.

3. The wind scoop according to claim 2 wherein the hatch is a closeable hatch and includes a cover, and wherein the lower wind directing portion fits over said cover.

4. The adjustable wind scoop according to claim 1 or 2 wherein the lower wind directing portion directs the flow of air from the upper wind catching portion downward through the opening.

5. The wind scoop in according to claim 1 or 2 further comprising an electrically operated fan located in said lower wind directing portion for directing and for accelerating the air flow.

6. The wind scoop in according to claim 5 wherein said fan is mounted to the lower wind directing portion.

7. The wind scoop in according to claim 5 wherein said fan is mounted to the frame of said hatch.

8. The wind scoop in according to claim 1 wherein the flexible material is sailcloth.

* * * * *